United States Patent [19]

Reifsnyder

[11] 4,112,640

[45] Sep. 12, 1978

[54] FOOT GRILLE

[75] Inventor: Howard B. Reifsnyder, Williamsport, Pa.

[73] Assignee: Construction Specialties, Inc., Cranford, N.J.

[21] Appl. No.: 857,793

[22] Filed: Dec. 5, 1977

[51] Int. Cl.[2] ..... E04F 19/10

[52] U.S. Cl. ..... 52/177; 52/667

[58] Field of Search ..... 52/664, 666, 667, 668, 52/171; 256/14, 17; 119/28

[56] References Cited

U.S. PATENT DOCUMENTS

| | | | |
|---|---|---|---|
| 1,946,035 | 2/1934 | Reuter | 52/180 |
| 2,082,197 | 6/1937 | Bates | 52/667 |
| 2,275,105 | 3/1942 | Greulich | 52/667 |
| 2,952,905 | 9/1960 | Lorig | 29/160 |
| 2,960,919 | 11/1960 | Nagin | 52/181 |
| 3,383,822 | 5/1968 | Viehmann et al. | 52/667 |
| 3,716,027 | 2/1973 | Vickstrom et al. | 119/28 |

FOREIGN PATENT DOCUMENTS

| | | | |
|---|---|---|---|
| 909,988 | 11/1962 | United Kingdom | 52/667 |
| 371,147 | 4/1932 | United Kingdom | 52/667 |

*Primary Examiner*—James L. Ridgill, Jr.
*Attorney, Agent, or Firm*—Brumbaugh, Graves, Donohue & Raymond

[57] ABSTRACT

A foot grille comprises closely spaced, parallel tread rails of uniform, T-shaped cross section joined by crosswise key lock bars. The lock bars are tightly wedged in triangular cutouts in the web portions of the rails between upper and lower flanges of the rails. The heights of the lock bars are greater than the heights of the web portions of the rails, and the lock bars are notched to receive the lower flanges of the rails, thus to fix the lower ends of the rails. The top edges of the bars tightly engage laterally spaced-apart areas of the undersides of the top flanges of the rails to fix the upper parts of the rails.

6 Claims, 3 Drawing Figures

FOOT GRILLE

BACKGROUND OF THE INVENTION

Foot grilles are often used at the entrances to public and commercial buildings to catch dirt that people entering would otherwise track into and through the building. The same grilles also can be used as gratings in places such as floor and walkway openings and the filter return overflow troughs around swimming pools.

The assignee of the present invention has for many years manufactured, in accordance with U.S. Pat. No. 3,383,822 issued May 21, 1968, a foot grille which is made from only two major components (plus, in most cases, a tread insert component) and which is very simple to assemble. The use of only two (or three) principal components and the ease of assembly have kept the cost low; the structure of the grille is such that, when properly fitted in a floor recess or opening having a flat rigid base for supporting the grille base throughout or keeping unsupported spans low, the grille stays tight and provides good service for many years.

The grille of U.S. Pat. No. 3,383,822 does lack one desirable property, a high transverse stiffness; the T-shaped tread rails provide considerable lengthwise stiffness, but the slotted lock bars are, structurally, little more than tie rods and, compared to the tread rails, provide only a moderate level of resistance to bending across the width. In some installations, notably those in which there are large unsupported spans, and under severe use over an extended time, the grille deflects and works and eventually loosens.

SUMMARY OF THE INVENTION

There is provided, in accordance with the present invention, a foot grille having greater transverse stiffness and, in general, greater overall strength and durability than the grille of U.S. Pat. No. 3,383,822. Like that grille, the grille of the present invention consists of two basic components, generally T-shaped tread rails and key lock bars, plus, in most cases, a tread insert. The tread rail has a vertical web portion, an upper flange and a lower flange. The lock bars pass through longitudinally spacedapart, generally triangular cutouts in the rails and are tightly wedged between the upper and lower flanges. Each cutout is bounded by a vertical edge that extends the full height of the web portion, a base edge that is coextensive with the juncture between the web portion and the bottom flange and an oblique (hypotenuse) edge having a length not less than the overall height of the lock bar.

The lock bar, which is preferably a simple strip of rectangular cross section having a height somewhat greater than the height of the web portion of the rail, has notches in its lower edge that receive the lower flanges of the rails. It is desirable to taper the lateral edges of the notches downwardly and outwardly away from each other and from the lower flanges to facilitate assembly by making it unnecessary to line up the lower flanges of the rails precisely with the notches of the lock bars and to permit a wedging action and interference fit between the notches and the lower flanges of the rail.

The upper apex of each cutout in the tread rail component is preferably a shallow notch shaped in profile to match and dimensioned to provide an interference fit with the upper edge of the lock bar, thus to fix the upper edge of the lock bar against moving longitudinally of the rail. The lower edge of the bar is locked in place by the wedging frictional engagement between the edges of the notch and the top and corner surfaces of the lower flange of the rail. As an optional but desirable aspect of the grille construction, the upper edge of each lock bar is received in a notch punched from a longitudinally continuous dependent rib on the underside of the upper flange of each rail laterally spaced from the web portion; the two point locking of the lock bar in notches on the rail supplements the frictional wedging of the lock bar between the upper and lower flange of the rail in keeping the grille from deforming from a true right angle between the rails and lock bars (i.e., from skewing).

In terms of strength and rigidity, the grille has the following characteristics:

(1) longitudinal stiffness — the tread rails are, in fact, small "I"-beams having considerable resistance to vertical deflection; the lock bars "tie" adjacent rails together rigidly for vertical load-sharing;

(2) transverse stiffness — the lock bars have effective heights equal to the heights of the web portions of the rails and effectively resist binding and carry vertical forces from rail to rail [vertical load-sharing, as in item (1)];

(3) lateral stability — the upper edges of the lock bars bear frictionally against zones of substantial area over the total lateral spans of the upper flanges of the rails, and the lower edges of the lock bars are fixed to the rails by the notches; the rails cannot, therefore, tip or lean laterally;

(4) horizontal stability — the two point locking of the upper edges of the lock bars to the upper flange of each rail at each connection prevents horizontal deformation from the perpendicular relation between the rails and bars (horizontal skew).

For a better understanding of the invention, reference may be made to the following description of exemplary embodiments, considered in conjunction with the figures of the accompanying drawings.

DESCRIPTION OF EXEMPLARY EMBODIMENTS

Figure 1:
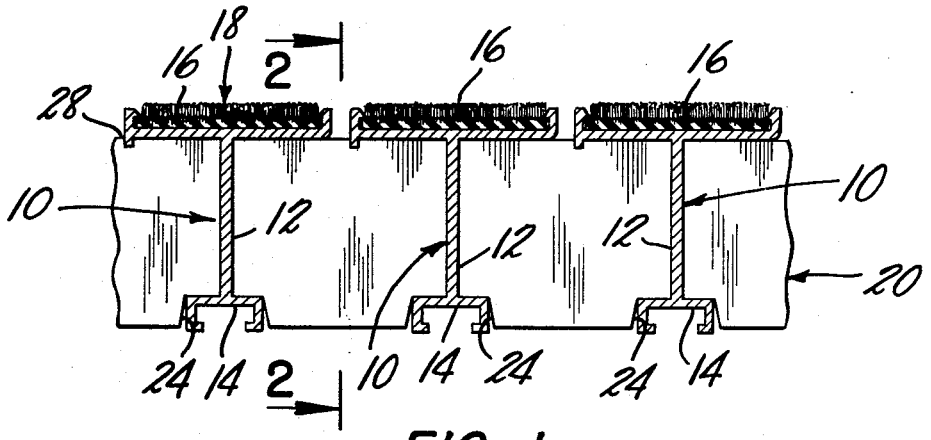
FIG. 1 is an end view in cross section of the embodiment, portions being broken away to reduce duplication and permit enlargement of the scale.
Figure 2:
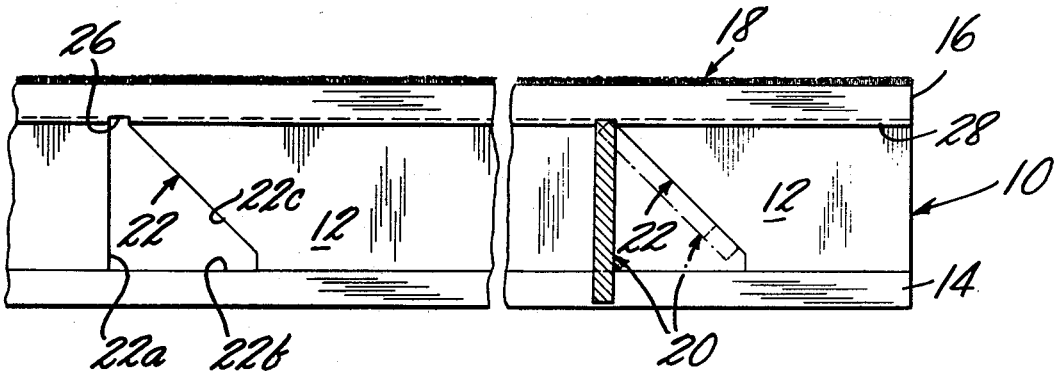
FIG. 2 is a side view in cross section of the embodiment of FIG. 1, portions being broken away.

The grille shown in FIGS. 1 and 2 comprises a number of side-by-side closely-spaced parallel tread rails 10, all of which are pieces cut to the required length from an extrusion and are therefore of identical, uniform cross section. Each rail 10 is generally T-shaped in cross section, having a vertical web portion 12, a lower flange 14, which consists of complementary generally U-shaped parts configured to provide lateral stiffness and top, side and bottom faces of substantial area, and an upper flange 16 of very shallow "U"-shape to provide a trough for reception of a tread insert 18. In the embodiment shown in FIGS. 1 and 2, the tread insert is a strip of carpet, but the trough can also receive a plastic insert or be filled with a non-slip abrasive binder material. The carpet form of insert is based on U.S. Pat. No. 3,383,822.

The tread rails 10 are rigidly joined together by key lock bars 20 received at intervals along the length of the rails through generally triangular cutouts 22 in the web portions 12 of the rails. Each cutout has a vertical edge 22*a* extending the full height of the web portion, a base edge 22*b* that is coextensive with the juncture between the web portion and the lower flange 14, and an oblique (hypotenuse) edge 22*c* having a length greater than the overall height of the lock bar 20 so that the lock bar can be slided endwise through the cutout by orienting it oblique to the top flange, as shown by phantom lines in FIG. 2.

The lock bars 20 are flat metal strips of rectagular cross section having notches 24 punched out along the lower edge. The lateral edges of the notches 24 taper downwardly and outwardly relative to each other and to the adjacent lateral walls of the lower flanges of the rails.

At the upper apex of each cutout 22 in the web portion 12 of each rail is a small rectangular notch shaped and dimensioned to match the cross section of the upper edge of the key lock bar 20. That notch is in register (and, as shown in FIG. 2, therefore, coincides) with a similar small rectangular notch 26 cut into a longitudinal, dependent rib 28 on the underside of the upper flange 16 of the rail.

The grille is assembled by positioning the rails 10 in a jig, sliding the lock bars 20 through the aligned cutouts (by turning them to be oblique to the upper flanges of the rails), starting the upper edges of the bars into the notches at the upper apexes of the cutouts 22 and in the ribs 28 and then forcibly rotating the bars about their upper edges until the bars are tightly wedged vertically between the upper and lower flanges of the rails. The vertical edges 22*a* provide stop surfaces limiting the rotating of the bars upon assembly and establishing the final vertical position.

The role or function of frictional engagement arising from the interference fits between the top edges of the lock bars 20 and the notches at the tops of the slots 22 in the rails and between the notches 24 in the lock bars and the lower flanges 14 of the rails 10 to keep the lower edges of the lock bars from becoming dislodged and rotating about the upper edges (i.e., from unlocking) can be supplemented by small upset punches (not shown) at intervals into the lower flanges of the rails from below at places where the lock bars cross.

Figure 3:
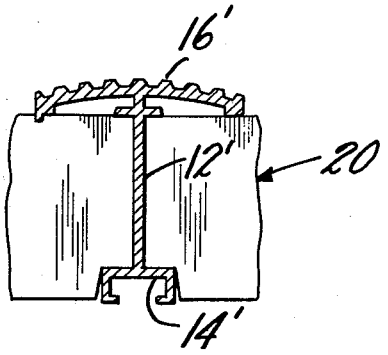
FIG. 3 is an end cross-sectional view of another embodiment of the grille.

The grille shown in FIG. 3 has the same overall construction as that shown in FIGS. 1 and 2. The only difference is that the rails of the grille of FIG. 3 do not have tread inserts. Thus, the top flange 16' of the rail has a grooved upper tread surface and outwardly extending rib portions at the top of the web portion 12'; the upper edges of the lock bars 20 frictionally engage the rib portions and the lateral extremities of the rail flanges 16'.

I claim:

1. In a foot grille having a multiplicity of parallel closely-spaced elongated tread rails, each of which is generally T-shaped in cross section, is of substantially uniform cross section along its length and includes in cross section an upper flange, a lower flange and a web portion, and at least two spaced-apart key lock bars extending transversely of the rails, passing through the web portions of the rails and rigidly interconnecting the rails, the improvement wherein the web portion of each rail has longitudinally spaced-apart generally triangular cutouts, each of which has a vertical edge substantially perpendicular to the longitudinal axis of the rail and extending substantially the full height of the web portion between the flanges, a lower edge substantially co-extensive with the juncture between the web portion of the lower flange and an oblique edge having a length not less than the height of the lock bar such that the lock bar can be passed lengthwise through the cutout, and wherein each lock bar has a height greater than the height of the web portion of the rail and has notches along its lower edge receiving and engaging lower flanges of the rails, portions of the upper edge of each lock bar engaging at least two areas on the underside of the upper flange of each rail at locations spaced a substantial distance from each other lengthwise of the lock bar, and portions of one face of each lock bar engaging the vertical walls of the cutouts in the rails.

2. A foot grille according to claim 1, wherein the lateral edges of the notches at the lower edge of each lock bar taper downwardly away from each other and from the adjacent lateral faces of the lower flange of the rail to facilitate rotating the lock bar into the assembled positions.

3. A foot grille according to claim 1, wherein the underside of the upper flange of each rail is substantially flat across its entire width, and the upper edge of each lock bar engages a band on the underside of the upper flange of each rail across substantially the entire width of the upper flange.

4. A foot grille according to claim 1, wherein the upper flange of each rail includes a center portion having parts extending laterally outwardly on either side of the web portion and edge portions on either side of the web portion spaced laterally outwardly from the respective parts of the center portions, the under surfaces of the center portion and marginal portions being substantially coplanar and being engaged by the upper edge of the lock bar.

5. A foot grille according to claim 1, wherein the upper corner of each rail cutout has a profile substantially matching the cross-sectional shape of the upper edge of the lock bar, so that the upper edge of the lock bar is restrained from moving lengthwise of the rail.

6. A foot grille according to claim 5, wherein the upper flange of each rail includes a longitudinal dependent rib spaced laterally from the web portion, and wherein that rib has notches at positions transversely aligned with the upper edges of each cutout in the web portion, each notch having a shape in profile matching substantially the shape in cross section of the upper edge portion of the lock bar and receiving that upper edge portion to prevent it from moving lengthwise of the rail.

* * * * *